US008579301B2

(12) United States Patent
Smith

(10) Patent No.: US 8,579,301 B2
(45) **Date of Patent: *Nov. 12, 2013**

(54) ARTICULATED TWO-PIECE SNOWBOARD WITH RIGID, FLEXIBLE CONNECTOR

(76) Inventor: Shane Smith, Malibu, CA (US)

( * ) Notice: Subject to any disclaimer, the term of this patent is extended or adjusted under 35 U.S.C. 154(b) by 229 days.

This patent is subject to a terminal disclaimer.

(21) Appl. No.: 13/036,844

(22) Filed: Feb. 28, 2011

(65) Prior Publication Data

US 2011/0148074 A1 Jun. 23, 2011

Related U.S. Application Data

(63) Continuation-in-part of application No. 11/299,257, filed on Dec. 9, 2005, now Pat. No. 7,896,365.

(51) Int. Cl.
*A63C 5/00* (2006.01)

(52) U.S. Cl.
USPC ..... 280/14.21; 280/607; 280/609

(58) Field of Classification Search
USPC ..... 280/14.21, 14.22, 14.25, 14.23, 602, 280/608, 16, 609, 607
See application file for complete search history.

(56) References Cited

U.S. PATENT DOCUMENTS

| | | | | |
|---|---|---|---|---|
| 3,871,671 | A | 3/1975 | Bildner | |
| 4,163,565 | A * | 8/1979 | Weber | 280/14.21 |
| 4,262,919 | A * | 4/1981 | Krent | 280/16 |
| 4,955,632 | A | 9/1990 | Prestipino Giarritta et al. | |
| 5,462,304 | A | 10/1995 | Nyman | |
| 5,618,051 | A * | 4/1997 | Kobylenski et al. | 280/14.21 |
| 5,865,446 | A * | 2/1999 | Kobylenski et al. | 280/14.23 |
| 6,062,585 | A * | 5/2000 | Hess | 280/608 |
| 6,224,085 | B1 | 5/2001 | Cruz | |
| 6,270,091 | B1 | 8/2001 | Smith | |
| 6,648,347 | B1 * | 11/2003 | Rieg | 280/14.25 |
| 6,834,867 | B2 | 12/2004 | Smith | |
| 7,100,927 | B2 | 9/2006 | Krent | |
| 7,896,365 | B2 | 3/2011 | Smith | |
| 2002/0195780 | A1 | 12/2002 | Karlsen | |
| 2004/0084878 | A1 * | 5/2004 | Adamczewski | 280/602 |
| 2004/0100067 | A1 * | 5/2004 | Riepler et al. | 280/602 |
| 2004/0227311 | A1 * | 11/2004 | Sanders | 280/14.22 |
| 2005/0110230 | A1 | 5/2005 | Seymour | |

* cited by examiner

*Primary Examiner* — Hau Phan
(74) *Attorney, Agent, or Firm* — Kenneth L. Green

(57) ABSTRACT

A two-piece snowboard includes an improved bottom shape and connector. The bottom surface of each snowboard section facilitates three primary functions: riding in a straight line, turning, and stopping. The bottom surfaces are concave or substantially flat, and grooves or ribs are provided along bottom edges of the sections to provide for turning and/or braking. Thus placed, the grooves and/or ribs do not interfere with straight line riding. The connector is somewhat stiff, and resists twisting. An example of a suitable connector is a length of reinforced hydraulic hose. The connector allows both vertical and horizontal flexing to facilitate riding over irregular terrain, while resisting twisting between sections to facilitate control. In one embodiment, the two-piece snowboard is constructed from sandwiching upper platforms provided by a donor snowboard between a connector assembly and bottom platforms according to the present invention.

17 Claims, 9 Drawing Sheets

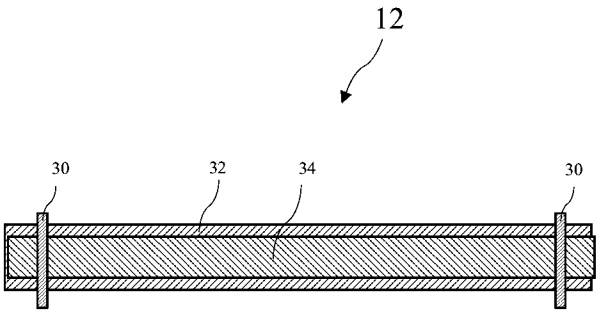
FIG. 3
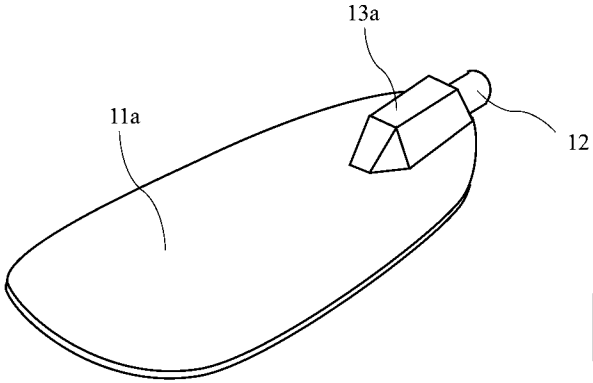
FIG. 4
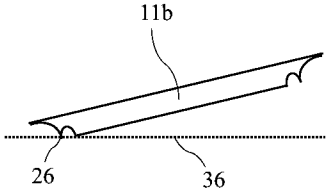
FIG. 5A
FIG. 5B
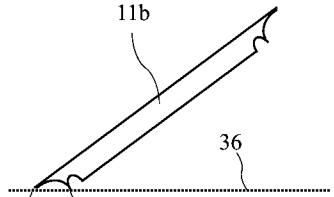
FIG. 5C

ARTICULATED TWO-PIECE SNOWBOARD WITH RIGID, FLEXIBLE CONNECTOR

The present application is a Continuation In Part of U.S. patent application Ser. No. 11/299,257 filed Dec. 9, 2005, which application is incorporated in its entirety herein by reference.

BACKGROUND OF THE INVENTION present invention relates to sporting boards and in particular to snowboards.

In the past, commercial snowboards have been limited in their ability to make sharp turns and maneuver over uneven surfaces and around moguls. In addition, known snowboards are awkward to store and transport. U.S. Pat. No. 6,270,091, filed by the inventor of the present invention, addressed the limitations of the one-piece snowboard by describing an articulated two-piece (or two section) snowboard. The sections are joined by a connector which allows horizontal (side to side) movement, and vertical (up and down) movement (although one embodiment substantially prevents vertical movement) of one section relative to the other section. The connector of the '091 patent further provides only marginal resistance to twisting of one section relative to the other section, and as a result, the snowboard may be difficult to control. Both front and rear sections have a uniquely shaped convex bottom with ridges to facilitate movement through the snow, turning, and braking. The '091 patent specifically describes a plurality of longitudinally running ribs and/or grooves on the bottom of each snowboard section.

U.S. Pat. No. 6,834,867, filed by the inventor of the present invention, describes a two-piece snowboard including a connector which behaves like a piece of vertical spring steel, still allowing flexing from side to side, while substantially preventing up and down flexing. Unfortunately, the lack of vertical flexing in some embodiments of the '091 patent and in the '867 patent in general, makes it difficult to follow much of the irregular terrain enjoyed by snowboard riders. The snowboard described in the '867 patent also includes the bottom and ribs and/or grooves of the '091 patent. Due to the shape of the bottom and the ribs of the snowboards described in the '091 and '867 patents, the ribs (and/or grooves) generally contact the snow surface while traveling in a straight line. Such contact may result in increased drag and thus limit snowboard speed. The '091 patent and the '867 patent are herein incorporated by reference.

BRIEF SUMMARY OF THE INVENTION

The present invention addresses the above and other needs by providing an articulated, two-piece snowboard with front and rear sections joined with a horizontally and vertically flexing, substantially non-twisting, connector, each section providing a platform for one foot. The bottom surface of each section is composed of two areas, a somewhat flat or concave riding platform which runs from front to back of each section for gliding in a straight line, and turning areas on the outside left and right sides of each section which do not continuously engage the snow when riding in a straight line. The turning areas do engage the snow when the rider rolls the snowboard to the left or right around its longitudinal axis. Preferably, the turning areas have one or more longitudinal turning ridges. In addition, when the snowboard is rolled far enough (i.e., beyond that required for engagement of the turning ridges) a hard outer stopping edge is engaged for the purpose of rapid slowing or stopping. In one embodiment, the two-piece snowboard is constructed from sandwiching upper platforms provided by a donor snowboard between a connector assembly and bottom platforms according to the present invention.

In accordance with one aspect of the invention, there are provided alternate embodiments providing ways to tune the performance of the snowboard to suit different conditions and riders, including various bottom shapes. In one alternate embodiment, the present invention is similar to known snowboards in construction and shape of bottom, but includes the connector according to the present invention. In another embodiment concerning the connector, the connector may be detachable from at least one section for the purpose of transporting the snowboard or for the purpose of substituting a section or connector with different characteristics. The connector may further be adjustable so that the rider may modify riding characteristics of the snowboard.

In accordance with another aspect of the invention, there is provided a connector to couple sections of the two-piece snowboard. The connector does not allow a noticeable twist (i.e., does not allow rotation or twisting of the sections about the connector axis in opposite directions), but does allow independent movement of the snowboard in the horizontal and vertical planes. The snowboard according to the present invention thus provides a smooth and enjoyable ride with enhanced capabilities, allowing the rider to glide over mounds of snow without a stiff connector preventing vertical flex between the connectors. In a preferred embodiment, the connector is one that functions similarly to a length of reinforced hydraulic hose.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein:

FIG. 3 is a detailed cross-sectional view of a connector according to the present invention, taken along line 2-2 of FIG. 1A.

FIG. 4 is a perspective view of one end of the snowboard.

FIG. 5A is a cross-sectional view of the snowboard taken along line 5-5 of FIG. 1B with the snowboard flat.

FIG. 5B is a cross-sectional view of the snowboard taken along line 5-5 of FIG. 1B with the snowboard tilted for turning.

FIG. 5C is a cross-sectional view of the snowboard taken along line 5-5 of FIG. 1B with the snowboard tiled for stopping.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1A:
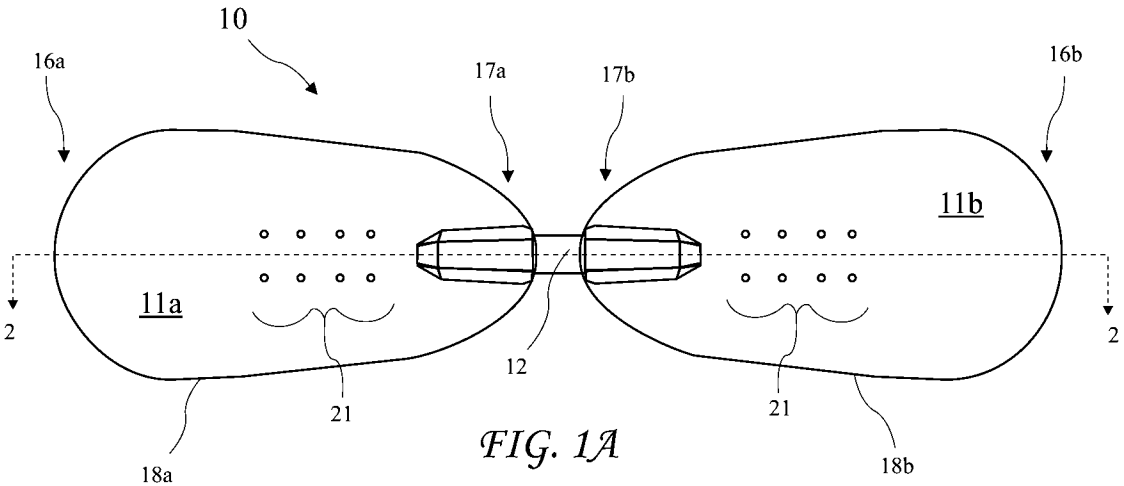
FIG. 1A is a top view of a two-piece snowboard according to the present invention.
Figure 1B:
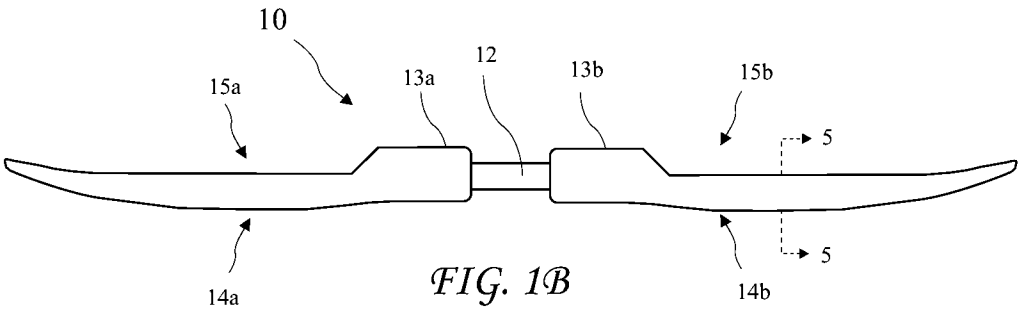
FIG. 1B is a side view of the snowboard according to the present invention.

A top view of a snowboard 10 according to the present invention is shown in FIG. 1A and a side view of the snowboard 10 is shown in FIG. 1B. The snowboard 10 comprises a first section 11*a* and a second section 11*b* connected by a connector 12. The sections 11*a* and 11*b* may be substantially identical or they may differ in size, shape or construction to alter the performance characteristics of the snowboard 10. The sections 11*a* and 11*b* have outer (or leading) edges 18*a* and 18*b* respectively and trailing edges 17*a* and 17*b* respectively.

The connector 12 is embedded into connector housings 13*a* and 13*b* of the sections 11*a* and 11*b* respectively. Preferably between approximately one inch and approximately 12 inches of the connector 12 is exposed between the connector housings 13*a* and 13*b*, and more preferably between approximately two inches and approximately five inches of the connector 12 is exposed between the connector housings 13*a* and 13*b*, and most preferably approximately three inches of the connector 12 is exposed between the connector housings 13*a* and 13*b*. The connector 12 preferably has a diameter between approximately 0.75 inches and approximately 1.75 inches, and more preferably has a diameter of approximately 1.5 inches. Binding mountings 21 reside on the top surfaces 15*a* and 15*b*, providing for mounting bindings to the snowboard 10. The binding mountings 21 are preferably in female thread inserts mounted or molded into the snowboard in a common pattern.

The shape of the snowboard 10, when viewed from the top, is preferentially slightly wider towards the leading edges 16*a* and 16*b* and slightly more narrow towards the trailing edges 17*a* and 17*b* of the sections 11*a* and 11*b*. A snowboard 10 rider places a first foot in a first binding mounted to a top surface 15*a* of the section 11*a* and a second foot in a second binding mounted to the top surface 15*b* of the section 11*b*, preferably, with feet at angles to the longitudinal axis in a stance similar to that used by traditional snowboarders.

Some known two-piece snowboards, such as described in U.S. Pat. Nos. 6,270,091 (in one embodiment) and 6,834,867, allow side to side movement of sections 11*a* with respect to the section 11*b*, but do not allow up and down (i.e., vertical) movement. As a result, known two-piece snowboards do not allow a smooth ride over irregular terrain. In contrast, the snowboard 10 of the present invention allows vertical flex and thus provides a smoother more enjoyable ride, allowing the rider to glide over mounds of snow without a stiff connector preventing vertical flex between the sections 11*a* and 11*b*. The '091 and '867 patents are incorporated by reference above.

The connector 12 allows some lateral (right or left) flex and some vertical (up or down) flex, but preferably has a very high resistance to twisting. The connector 12 thus allows independent movement of the sections 11*a* and 11*b* in horizontal and vertical planes, but allows negligible rotation or twisting of the sections 11*a* and 11*b* about the connector 12 axis in opposite directions.

The connector 12 is preferably made from a material exhibiting substantially no twist in normal use (i.e., an amount of twist not noticeable to a rider). The following characterizes the physical characteristics of the connector 12 independent of the snow board. The connector 12 more preferably exhibits between approximately 0.001 degrees per inch-pound of torque and approximately 0.005 degree per inch-pound of torque, and most preferably exhibits between approximately 0.0015 degrees per inch-pound of torque and approximately 0.003 degree per inch-pound of torque. The flexure of the connector 12, based on the ASTM Test Method D-790 and applying a force to the center of the connector supported by a six inch span, is preferably between approximately 0.001 inches of deflection per pound and approximately 0.006 inches of deflection per pound, and more preferably between approximately 0.0015 inches of deflection per pound and approximately 0.0045 inches of deflection per pound.

The above connector characteristics assume an approximately three inch separation of the sections 11*a* and 11*b*. Equivalent characteristics may be obtained by using a stiffer connector 12 with a greater than three inch separation, or a less stiff connector 12 with a shorter separation, and snowboards with greater separation and a stiffer connector, or with lesser separation and a less stiff connector are intended to come within the scope of the present invention. Further, while most riders prefer a flexure between approximately 0.001 inches of deflection per pound and approximately 0.006 inches of deflection per pound, some more experienced or more aggressive riders, or when riding on some surfaces, for example moguls, greater flexure of the connector may be preferred. For example, flexure of up to approximately 0.012 inches of deflection per pound or even 0.018 inches of deflection per pound may be preferred by some riders or in some conditions.

The various flexures of the connector 12 provide a different ride or feel for the rider, and a connector 12 with less flexure may be more desirable for some conditions or riders, and a connector 12 with more flexure many be more desirable for other conditions or riders. The connector 12 is preferably substantially non-compressible in length, although a small amount of compression is allowable as long as the sections 11*a* and 11*b* do not contact as a result of compression of the connector 12. An example of a suitable connector 12 is a length of reinforced hydraulic hose such as Parker Hannifin® 471ST-16 hose or a similar hose having two braids of steel wire. However, the present invention is not limited to a specific hose type, and suitable hoses may have zero to three braids (or layers) of steel wire reinforcement, and may be other hydraulic hose, air-conditioning hose, pneumatic hose, and the like. Any two-piece snowboard with a connector having physical characteristics similar to those described herein, or characteristics similar to the characteristics of the Parker Hannifin® 471ST-16 hose, is intended to come within the scope of the present invention.

Figure 1C:
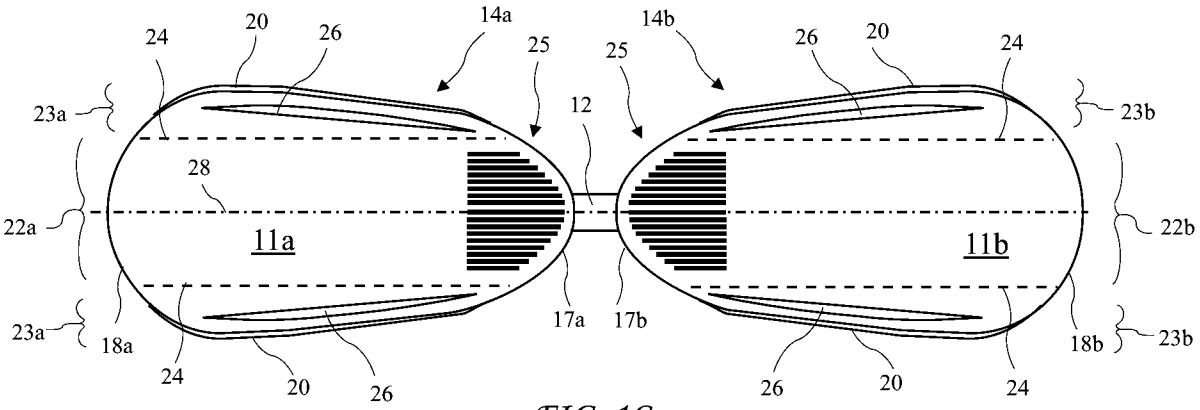
FIG. 1C is a bottom view of the snowboard according to the present invention.

A bottom view of the snowboard 10 is shown in FIG. 1C. The snowboard 10 includes the bottom (or riding) surfaces 14*a* and 14*b* comprising platform portions 22*a* and 22*b* for straight riding and edge portions 23*a* and 23*b* having at least one control surface for turning and/or stopping. The platform portions 22*a* and 22*b*, and the edge portions 23*a* and 23*b* are generally substantially identical (for example, within manufacturing tolerances), but may be different to suit specific rider preferences or uses.

The platform portions 22*a* and 22*b* preferably comprise substantially flat or slightly concave surfaces and extend lengthwise along the riding surfaces 14*a* and 14*b* creating a stable platform for the rider of the snowboard 10, and more preferably comprise a flat surface. A flat surface tends to provide a faster ride for experienced riders, and a concave surface tends to provide better control for inexperienced riders. The platform portions 22*a* and 22*b* are pointed out by left and right dashed lines 24, for visualization purposes only. The platform portions 22*a* and 22*b* preferably extend approximately 75% of the width of the riding surfaces 14*a* and 14*b*, although the actual percent of width may depend on the length and width of the riding surfaces 14*a* and 14*b*, and the platform portions 22*a* and 22*b* preferably reside over the longitudinal snowboard centerline 28 and more preferably are centered on the riding surfaces 14*a* and 14*b*. The lowest point(s) on the platform portions 22*a* and 22*b* are preferably lower (closer to the snow) than leading edges 16*a* and 16*b*, and trailing edges 17*a* and 17*b* (see FIGS. 1A and 1B).

Figure 6B:
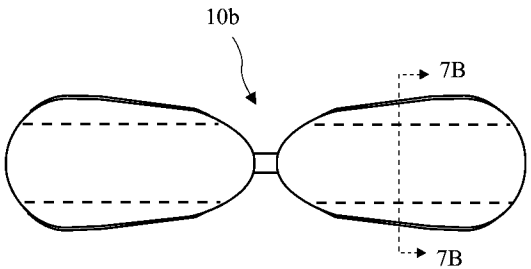
FIG. 6B is a bottom view of a snowboard according to the present invention with a smooth snowboard bottom.
Figure 6A:
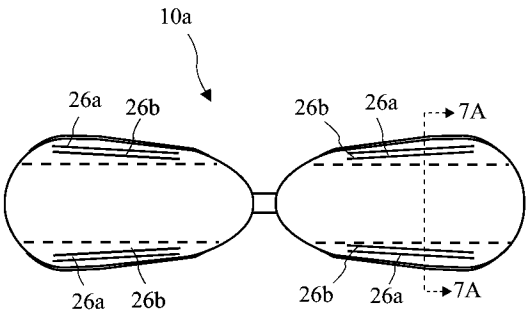
FIG. 6A is a bottom view of a snowboard according to the present invention with two ridges on each side of the snowboard.
Figure 6D:
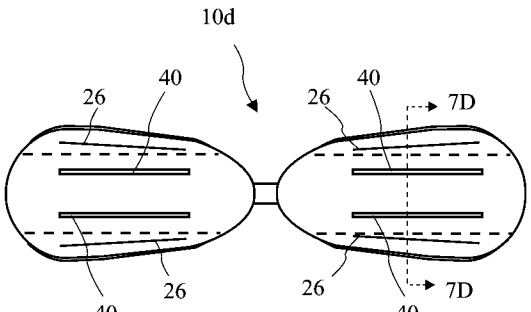
FIG. 6D is a bottom view of a snowboard according to the present invention with one ridge on each side of the snowboard bottom and two grooves on a platform surface of the snowboard bottom.
Figure 6C:
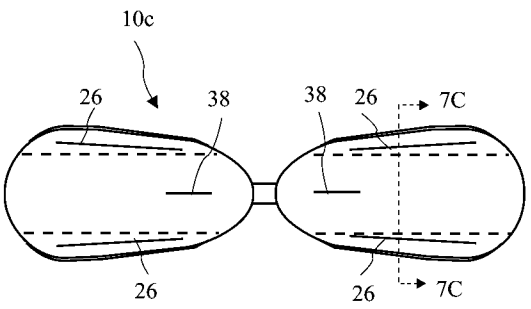
FIG. 6C is a bottom view of a snowboard according to the present invention with one ridge on each side of the snowboard bottom, and a short center ridge.

In one embodiment, the platform portions 22*a* and 22*b* are substantially smooth, and in another embodiment, the platform portions 22*a* and 22*b* include ridges 26 (see FIG. 6C and 6D). The ridges may comprise one or two well pronounced ridges, or a larger number of less pronounced ridges, or some graduation or combination of one or two well pronounced ridges and a large number of less pronounced ridges. The ridges preferably extend downward between 1/64 inch and approximately one inch, and more preferably extend downward between approximately 1/8 inch and approximately 3/8 inch. Additionally, corrugated surfaces 25 may be provided on the platform portions 22*a* and 22*b* proximal to the connector 12, which corrugated surfaces 25 may comprise a multiplicity of grooves or ridges which may have sharp edges or rounded edges.

Continuing with FIG. 1C, the edge portions 23*a* and 23*b* include control surfaces preferably comprising stopping edges 20 and generally including ridges 26. The stopping edges 20 are preferably sharp and engage the snow when the snowboard 10 is tilted about its longitudinal axis (or centerline) 28 for the purpose of slowing or stopping. The stopping edges 20 are preferably a separate material strip that is inserted and secured with adhesive or molded into the outer edges 18*a* and 18*b* extending between the leading edges 16*a* and 16*b*, and trailing edges 17*a* and 17*b*. The stopping edges 20 also may serve to reinforce the edges 18*a* and 18*b* of the snowboard 10. The ridges 26 are preferably a separate material which is inserted and secured with adhesive or molded into the edge portions 23*a* and 23*b*, generally for turning, and may be partially covered by the material covering the snowboard exterior. The separate material preferably is a hard material with characteristics similar to the hardness, stiffness, and abrasion resistance of steel. For example, the separate material may be a metal, or a composite hybrid plastic such as carbon fiber/kevlar composite.

Still continuing with FIG. 1C, the one or more turning ridges (or protrusions) 26 may extend longitudinally along the bottom surfaces of the snowboard 10, positioned outside the riding platform boundaries 24 (e.g., in the edge portions 23*a* and 23*b*) and between the boundaries 24 and the stopping edges 20. The turning ridges 26 are preferably substantially parallel to the stopping edges 20. The ridges 26 are preferably angled out, with the front of the ridge 26 farther from the longitudinal centerline 28 of the snowboard 10 than the rear of the ridge 26, moving away from the connector 12.

The ridges 26 are not effectively engaged, and do not substantially dig into the snow, until a rider tilts (or tips) the snowboard 10 to one side. Tipping the snowboard 10 to one side around its longitudinal axis 28 causes the turning ridge 26 to engage the snow, and causes the snowboard 10 to turn in the direction the snowboard has tipped. Some riders may further prefer either the addition of the short ridges (see FIGS. 6C and 7C) or the addition of grooves (see FIGS. 6D and 7D) on the platform portions 22*a* and 22*b* in order to provide greater directional control, but these additions are not required.

The stopping edges 20 and/or the ridges 26 may be fixed or may be adjustable. For example, adjusting screws may be included inside the sections 11*a* and 11*b*, which adjusting screws engage the stopping edges 20 and/or the ridges 26 wherein turning the screws extend or retract the stopping edges 20 and/or the ridges 26.

Figure 2:
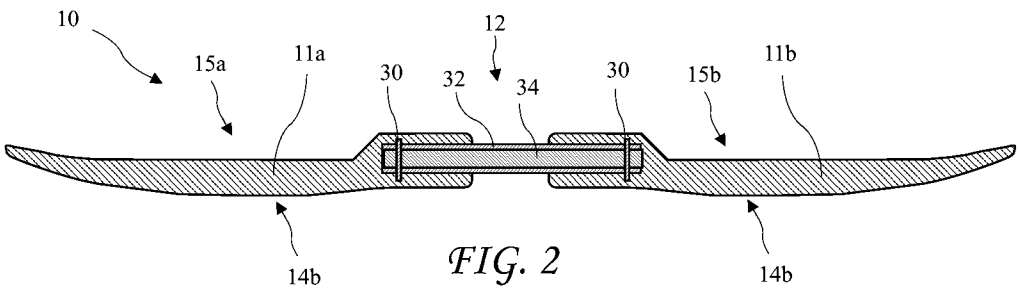
FIG. 2 is a cross-sectional view of the snowboard taken along line 2-2 of FIG. 1A.

A cross-sectional view of the snowboard 10 taken along line 2-2 of FIG. 1A is shown in FIG. 2. The sections 11*a* and 11*b* are preferably made using injection molding, and preferably comprise a polymer resin or any material providing the necessary strength, shape and durability. The sections 11*a* and 11*b* may further include an insert of lightweight material which can be used within the mold to reduce weight. The sections 11*a* and 11*b* may still further include inserts of a reinforcing material to better hold binding mountings 21 residing in the sections 11*a* and 11*b* (see FIG. 1A). Alternatively, the sections 11*a* and 11*b* may comprise an inner core of foam, wood, composite, honeycomb or a similar material, with an outer layer which is a composite resin, but the outer layer may be any material which helps to provide a durable outer layer of adequate strength such as an injection molded plastic, a roto-molded plastic, a composite, a metal, carbon fiber, fiber glass or any other similar material. It is anticipated that snowboards may be made from various materials, and any two-piece snowboard made from any materials or combination of materials, wherein the sections of the snowboard are connected by a connector 12 according to the present invention, or wherein the riding surfaces includes platform surfaces and edge portions as described herein, is intended to come within the scope of the present invention.

A detailed cross-sectional view of the connector 12 is shown in FIG. 3, the connector 12 preferentially comprising a connector shell 32, a connector fill 34 residing inside the connector shell 32, and connector fasteners 30. The shell 32 is preferably a reinforced hydraulic hose, for example Parker Hannifin® 471ST-16 hose or the like, and preferably has an outside diameter of approximately 0.75 inches to approximately 1.75 inches, and more preferably has an outside diameter of approximately 1.5 inches. Further, any material with similar characteristics may be used. The fill 34 is preferably neoprene rubber, silicon, urethane or another rubber or material with similar characteristics, and is more preferably neoprene rubber. Alternatively, the connector 12 may be hollow. The fastener 30 is preferably a solid metal cylinder with diameter D and length L. The length L is preferably approximately 2⅛ inches, and the diameter D is preferably approximately ⅜ inch. The fasteners 30 are inserted through the connector 12 and is molded into place, encapsulated by the connector housings 13*a* and 13*b*. The fasteners 30 may be metal, an Ultra-High Molecular Weight (UHMW) plastic, a carbon fiber, or any sufficiently strong material. The connector 12 may further comprise a molded composite product with similar characteristics to connector of present invention.

A perspective view of the section 11*a*, the housing 13*a*, and a portion of the connector 12 is shown in FIG. 4.

A cross-sectional view of the snowboard 10 in a flat attitude taken along line 5-5 of FIG. 1B is shown in FIG. 5A. The platform portion 22*b* of the snowboard 10 is in contact with the snow 36, thus providing a low friction contact for a fast ride. While the snowboard 10 is in a flat attitude, the ridges 26, and the stopping edges 20 are not in substantial contact with the snow (i.e., are not in sufficient contact with the snow to noticeably affect the ride). A second cross-sectional view of the snowboard 10 in a moderately rolled (or tipped) attitude taken along line 5-5 of FIG. 1B is shown in FIG. 5B. The ridge 26 on the left side of the snowboard 10 is now in contact with the snow 36 to provide a left turn through the cooperation of the ridges 26 on the first and second sections 11*a* and 11*b* with the snow surface 36. A third cross-sectional view of the snowboard 10 in a significantly rolled attitude taken along line 5-5 of FIG. 1B is shown in FIG. 5C. The ridge 26 and the stopping edge 20 on the left side of the snowboard 10 are now in contact with the snow 36 to provide braking for the snowboard.

Several alternative embodiments of the snowboard 10 comprising variations in the snowboard bottom 10*b* are anticipated for specialized uses. A first alternative embodiment of the snowboard 10*a* is shown in FIG. 6A. The snowboard 10*a* had two ridges 26*a* and 26*b* in place of the single ridge 26. The ridges (or other bottom features) may be designed to be removable and/or changeable to allow the rider to customize the bottom surface of each section for snow conditions or for rider preference. For example, ridges set at a greater angle from the longitudinal axis would provide a rider with more extreme turning capabilities.

A second alternative embodiment of the snowboard 10*b* is shown in FIG. 6B. The ridge 26 is absent from the snowboard 10*b*. A third alternative embodiment of the snowboard 10*c* is shown in FIG. 6C. The snowboard 10*c* included the ridges 26, and additionally center ridges 38 near the connector 12. A fourth alternative embodiment of the snowboard 10*d* is shown in FIG. 6D. The snowboard 10*d* retains the ridges 26 and additionally a pair of grooves 40 residing on the platforms 22*a* and 22*b* (see FIG. 1C.) running about the length of the ridges 26, and near the outside edges of the platform regions 22*a* and 22*b*, and may improve directional control in some conditions, and may provide preferred riding characteristics for some riders. The grooves 40 may be rectangular, oval, triangular, or some other shape. The depth of the grooves can vary from very shallow too deep. The number of grooves can vary from one groove to many grooves. The length of the grooves can vary from very short to the full length of the section bottom. The grooves can be placed on only one section or on both sections and can be in different patterns on each section.

Figure 7A:
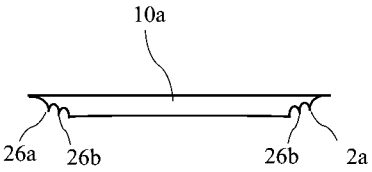
FIG. 7A is a cross-sectional view of the snowboard bottom taken along line 7A-7A of FIG. 6A.
Figure 7B:
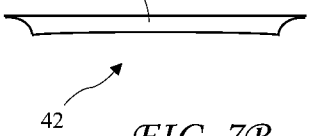
FIG. 7B is a cross-sectional view of the snowboard bottom taken along line 7B-7B of FIG. 6B.
Figure 7C:
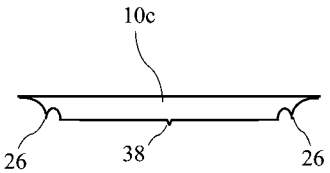
FIG. 7C is a cross-sectional view of the snowboard bottom taken along line 7C-7C of FIG. 6C.
Figure 7D:
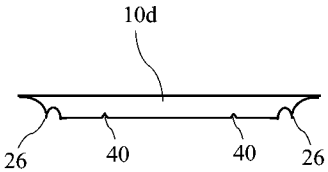
FIG. 7D is a cross-sectional view of the snowboard bottom taken along line 7D-7D of FIG. 6D.
Figure 7E:
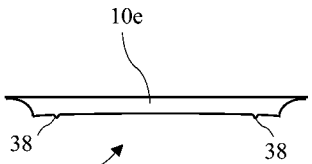
FIG. 7E is a cross-sectional view of a concave snowboard bottom with ridges.

Cross-sectional view of the alternative snowboards 10*a*, 10*b*, 10*c*, and 10*d* taking along lines 7A-7A, 7B-7B, 7C-7C, and 7D-7D are shown in FIGS. 7A, 7B, 7C, and 7D, respectively. The snowboard 10*a* with the ridges 26*a* and 26*b* are shown in cross-section in FIG. 7A. The snowboard 10*b* with a concave bottom 42 and without ridges is shown in FIG. 7B. The snowboard 10*c* with ridges 26 and center ridge 38 is shown in FIG. 7C. The snowboard 10*d* with ridges 26 and grooves 40 is shown in FIG. 7D. A snowboard 10*e* with a concave bottom 42 and a pair of ridges 38 on the platform portions 22*a* and 22*b* (see FIG. 1C) is shown in FIG. 7E. Other snowboards are contemplated with a combination of ridges and groove suitable for particular snow conditions or rider preferences, and any snowboard with a connector having the physical flexure characteristics of the connector 12 described above, is intended to come within the scope of the present invention.

Figure 9:
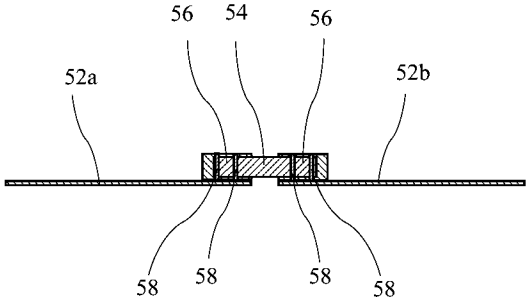
FIG. 9 is a cross-sectional view of the second embodiment of the two-piece snowboard taken along line 9-9 of FIG. 8A.
Figure 8A:
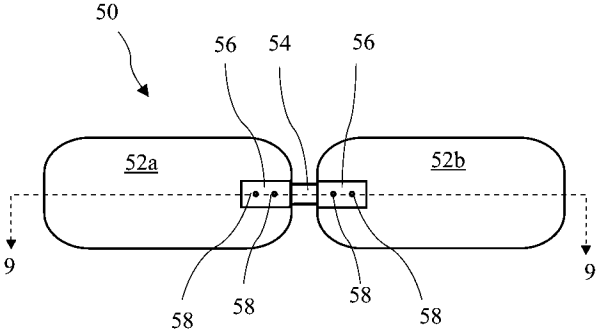
FIG. 8A is a top view of a second embodiment of the two-piece snowboard according to the present invention.
Figure 8B:
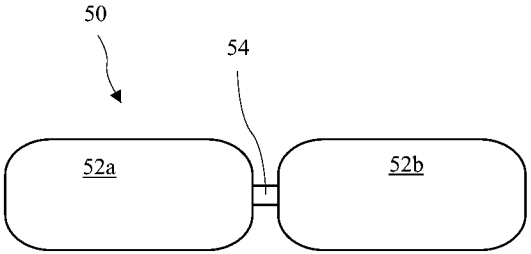
FIG. 8B is a side view of the second embodiment of the two-piece snowboard according to the present invention.

A top view of an alternative embodiment of a snowboard 50 according to the present invention is shown in FIG. 8A, and a bottom view of the snowboard 50 is shown in FIG. 8B. A cross-sectional view of the snowboard 50 taken along line 9-9 of FIG. 8A is shown in FIG. 9. The snowboard 50 comprises sections 52*a* and 52*b* which are similar to known one-piece snowboards and may include turning edges or ridges. The sections 52*a* and 52*b* are connected by a connector 54. The connector 54 is attached to the sections 52*a* and 52*b* by connector receptacles 56 and fasteners 58 passing through the receptacles 56 and connector 54. The connector 54 is preferably physically similar to the connector 12 above. The fasteners 58 are preferably bolts.

Figure 10A:
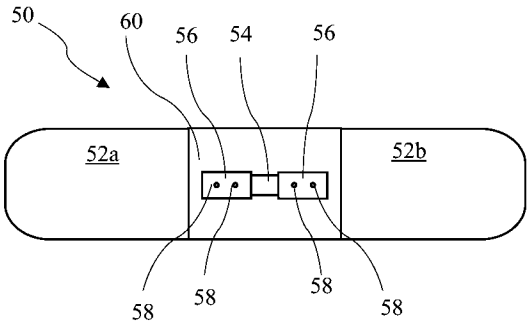
FIG. 10A is a top view of the second embodiment of the two-piece snowboard according to the present invention with a sleeve over a center portion of the snowboard.
Figure 10B:
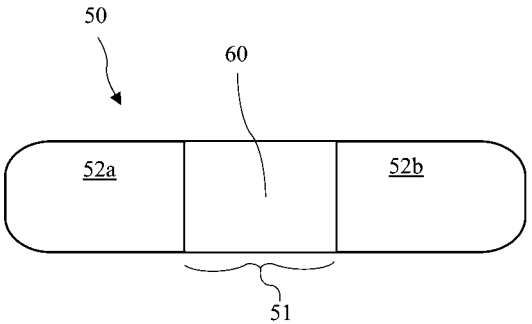
FIG. 10B is a bottom view of the second embodiment of the two-piece snowboard according to the present invention with the sleeve over the center portion of the snowboard.
Figure 10C:
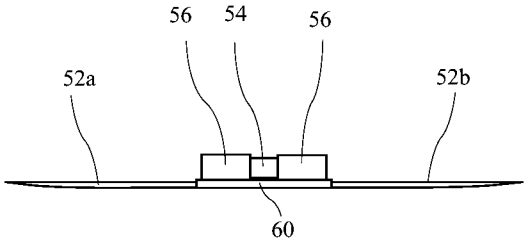
FIG. 10C is a side view of the second embodiment of the two-piece snowboard according to the present invention with a sleeve over a center portion of the snowboard.

A top view of the snowboard 50 is shown in FIG. 10A with a sleeve 60 residing over a center portion 51 of the snowboard 50, a bottom view of the snowboard 50 with the sleeve 60 is shown in FIG. 10B, and a side view of the snowboard 50 with the sleeve 60 is shown in FIG. 10C. The sleeve 60 may be cut out for the connector 54 and receptacles 56, or the fasteners 58 may pass through the sleeve 60. Providing the sleeve 60 may prevent snow from compacting between the sections 52*a* and 52*b*, and around the connector 54. The sleeve 60 is preferably made from a durable, flexible, slippery material.

Figure 11:
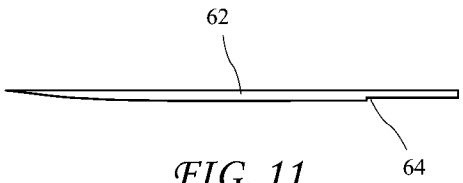
FIG. 11 is a side of a section of the snowboard with a notch for the sleeve.

A snowboard section 62 with an indentation 64 in the bottom surface is shown in FIG. 11. The section 62 may be used with the sleeve 60, and the indentation 64 may have a depth of approximately the thickness of the sleeve 60 to provide a flat surface when the sleeve 60 is over the center portion 51 of the snowboard 50.

Figure 12A:
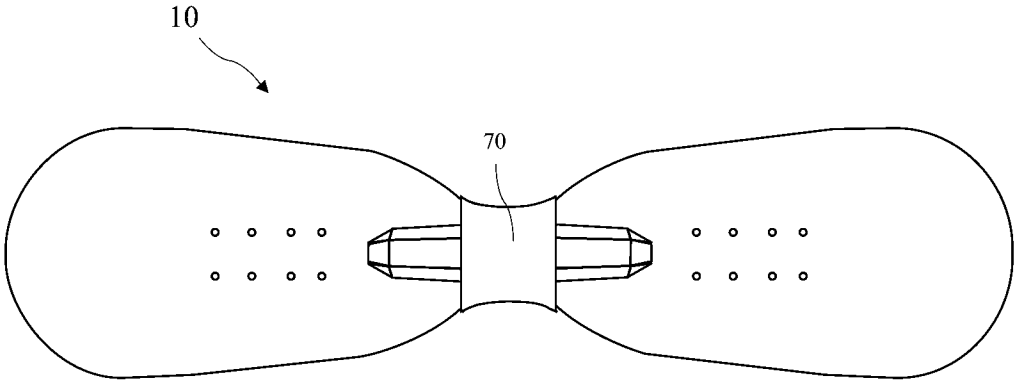
FIG. 12A shows a top view of the snowboard with a collar residing over the connector for riding rails.
Figure 12B:
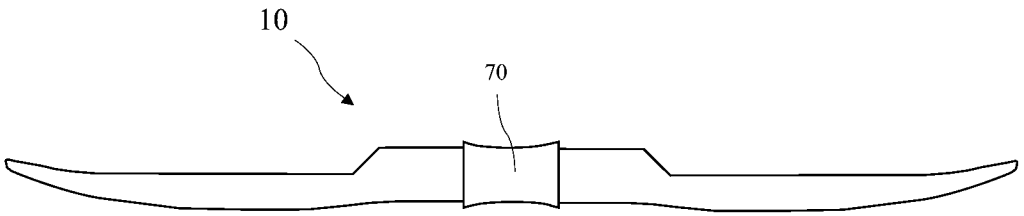
FIG. 12B shows a side view of the snowboard with the collar residing over the connector for riding rails.

A top view of the snowboard 10 with a rail collar 70 residing over the connector 12 for riding rails is shown in FIG. 12A, and a side view of the snowboard 10 with the rail collar 70 residing over the connector 12 is shown in FIG. 12B. The rail collar 70 may be placed over the connector 12 by separating one of the sections 11*a* or 11*b* from the connector 12 and sliding the rail collar 70 over the connector 12, for example, the rail collar 70 may comprise one or more doughnut shaped collars. Alternatively, the rail collar 70 may be a two-piece rail collar assembled over the connector 12 without separating one of the sections 11*a* or 11*b* from the connector 12. The rail collar 70 is preferably made from composite strips of hard, non-flexible composite material, aligned perpendicular to the longitudinal axis of the snowboard 10. The strips may reside on the underside of the collar 70 and be embedded in a collar body made from a more flexible material. The strips are preferably a hard vinyl or urethane, Ultra High Molecular Weight (UHMW), a hard-abrasive resistant composite, or the like. The collar body is preferably a urethane, a rubber, or the like.

Figure 13A:
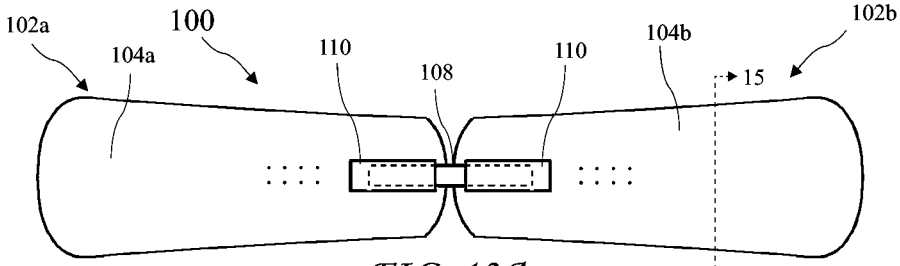
FIG. 13A shown a top view of an embodiment of the present invention constructed using a donor snowboard.
Figure 13B:
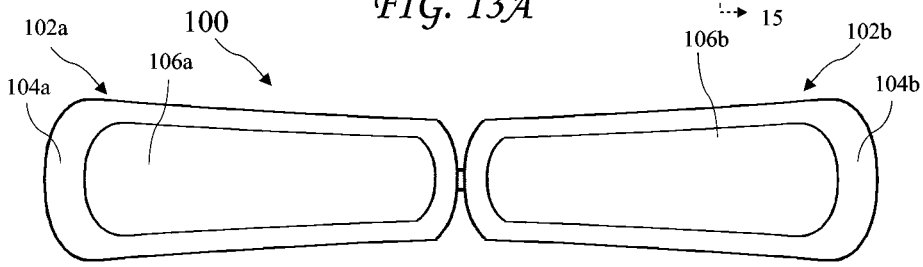
FIG. 13B shown a bottom view of the embodiment of the present invention constructed using a donor snowboard.
Figure 13C:
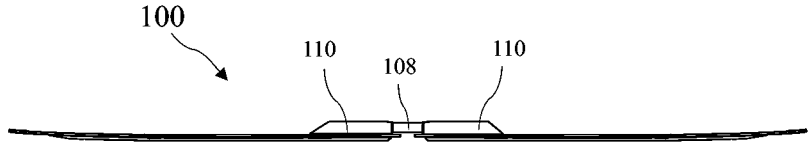
FIG. 13C shown a side view of the embodiment of the present invention constructed using a donor snowboard.
Figure 14:
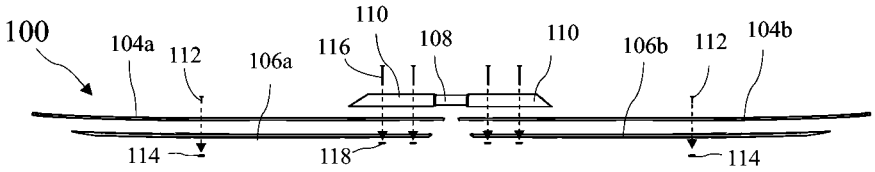
FIG. 14 shown an exploded side view of the embodiment of the present invention constructed using a donor snowboard.

A top view of an alternative embodiment of a snowboard 100 according to the present invention is shown in FIG. 13A, a bottom view of the snowboard 100 is shown in FIG. 13B, a side view of the snowboard 100 is shown in FIG. 13C, and an exploded side view of the snowboard 100 is shown in FIG. 14. The snowboard 100 is constructed from sandwiching upper platforms 104*a* and 104*b* provided by a donor snowboard between a connector assembly 108 and bottom platforms 106*a* and 106*b*. The snowboard 100 comprises sections 102*a* and 102*b*. The sections 102*a* and 102*b* are connected by the connector 108. The connector assembly 108 is attached to the sections 102*a* and 102*b* by fasteners 116 passing through connector housings 110 of the connector assembly 112, the upper platforms 104*a* and 104*b*, and the bottom platforms 106*a* and 106*b* into nuts 118. The connector housings 110 preferably comprise a polymer resin or any material providing the necessary strength, shape and durability. The connector assembly 100 preferably includes a connector physically similar to the connector 12 described above. The fasteners 116 are preferably threaded bolts secured with the nuts 118.

The snowboard 100 may be constructed by a method including the steps of: obtaining a donor snowboard; cutting the donor snowboard into two sections, each comprising half, or a portion of half, of the donor snowboard to form two upper platforms; attaching lower platforms to the upper platforms; and attaching the attached upper and lower platforms to a connector assembly.

Each section 102*a* and 102*b* of snowboard 100 may be constructed by attaching the upper platforms 104*a* and 104*b* to the bottom platforms 106*a* and 106*b* with two or more fasteners 112. The fasteners 112 are preferably threaded bolts secured with nuts 1114. The upper platforms 104*q* and 140*b* are preferably the same construction as known snowboards except that the bottom surfaces of upper platforms 104*a* and 104*b* preferably do not have a finished sliding surface. Upper platforms 104*a* and 104*b* may also comprise the materials described for constructing of the snowboard 10. The bottom platforms 106*a* and 106*b* preferably comprise a polymer resin such as urethane or of the materials of the snowboard 10. The bottom platforms 106*a* and 106*b* may also be the same construction as known snowboards except that the upper surface 191, shown in FIG. 14, would preferably not be finished. While constructing the snowboard 100 is described using threaded fasteners, the top and bottom platforms may be attached using other methods including glue or adhesives, and a snowboard 100 constructed using any material and/or methods is intended to come within the scope of the present invention.

Figure 15A:
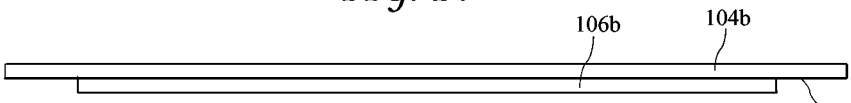
FIG. 15A shows a cross-sectional view of the embodiment of the present invention constructed using a donor snowboard and having a plain base, taken along line 15-15 of FIG. 13A.
Figure 15B:
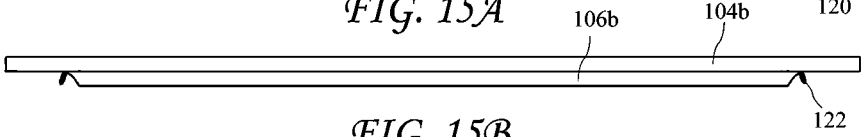
FIG. 15B shows a cross-sectional view of the embodiment of the present invention constructed using a donor snowboard and having a base including grooves and ridges, taken along line 15-15 of FIG. 13A.

A cross-sectional view of the snowboard 100 having a plain base features 120, taken along line 15-15 FIG. 13A, is shown in FIG. 105A, and an alternative embodiment of the snowboard 100 having a base with grooves and ridges 122 as described above for the snowboard 10 is shown in FIG. 15B. The snowboard 100 may include any of the structure described above for the snowboard 10, and in particular, the connector design and the base design.

Other structure and materials are contemplated for the connector, for example, a molded connector may be used. The molded connector preferably comprises a flexible composite with or without an insert such as carbon rod, hydraulic hose, UHMW rods or any other material that adds stiffness, flexibility or strength. The connector may further be removably connected to allow disconnection and reconnection from the snowboard sections. The connector may also be adjustable so that the rider may modify flex characteristics of the snowboard. For example, the connector may be adjustable in two ways: lengthening of the connector to accommodate riders of different length strides (for example, a short person may prefer a shorter connector) and making the connector more flexible or less flexible. The flexure may be adjusted by disassembling one of the sections 11*a* or 11*b* from the connector 12, and inserting a more stiff or less stiff insert into the connector 12, or placing a collar over the connector 12. Another method for increasing stiffness is to clamp a split collar over the connector 12. A more flexible connector would be better used for freestyle riding and a more stiff connector would usually be preferred for fast downhill riding (to decrease the chance of the paddles getting out of alignment and causing a fall)

Methods of use of a two-piece snowboard according to the present invention are described as follows. To ride in a straight line, the rider keeps the snowboard 10 flat with the platform surfaces 22*a* and 22*b* (see FIG. 1C) in contact with the snow. Preferably, the ridges 26 are out of contact with the snow, or do not substantially engage the snow, when riding in a straight line, resulting in a faster, smoother and more stable ride without drag and/or interference from the ridges 26.

To turn left, the rider tips the snowboard 10 around the longitudinal axis 28 (see FIG. 1C) by leaning to the left, engaging at least one ridge 26, and causing the snowboard to turn left. FIG. 5B illustrates the engagement of the ridge 26 in snow surface 36 while in a left turn; the snowboard is tipped left around the longitudinal axis 28 until the ridge 27 engages the snow 36 sufficiently to facilitate a left turn. A right turn is similarly accomplished by tilting the snowboard to the right. The rider also has the option of pointing the board by turning it with his feet.

To reduce speed or stop, the rider may turn the snowboard perpendicular to the direction of travel using the rider's feet, and then tilt the snowboard back around its longitudinal axis 28 to dig the ridges 26 or the ridges 26 and the stopping edge 20, into the snow, for example, tilt the snowboard farther than for turning. FIG. 5C illustrates the engagement of stopping edge 20 for the purpose of slowing or stopping the snowboard 10, wherein the snowboard 10 is tipped beyond the position illustrated in FIG. 5B until the stopping edge 20 engages the snow 36 sufficiently to slow or stop the snowboard 10. More specifically, stopping from slow speeds is easily done by turning the snowboard uphill, or by turning the rider's feet so that the snowboard is perpendicular to the direction of travel. When going faster, the rider may use his feet to turn the snowboard so that the snowboard is perpendicular to the direction of travel, just like is done with a conventional one piece snowboard, and then, for moderate speeds, the snowboard may be stopped by tipping and engaging the first ridge (turning ridge) or, for faster speeds or for steep slopes, the snowboard must be tipped farther back to engage the stopping edge.

An important addition to the present invention that was not included in my previous patents is the incorporation of preferentially hard stopping edges along the left and right sides of each section, constructed such that they dig in and grip the snow.

A rider may accomplish a controlled descent on a slope using the ridges 26 and/or the stopping edges 20 (see FIG. 1C). The snowboard 10 may be turned perpendicular to a path of descent down the slope and the rider may control his speed and/or stop by controlling the amount of engagement of the ridges 26 and/or the stopping edges 20 with the snow, for example by tilting the snowboard to dig the uphill edge into the snow.

The snowboard 10 may be designed for a targeted snow condition, and when riding under other than the targeted snow conditions, it would be expected that the ridges and/or stopping edges would engage the snow more or less when riding in a straight line, than described herein.

While the invention herein disclosed has been described by means of specific embodiments and applications thereof, numerous modifications and variations could be made thereto by those skilled in the art without departing from the scope of the invention set forth in the claims.

I claim:

1. A two-piece snowboard comprising:

a first snowboard section;

a first riding surface on the bottom of the first snowboard section, the first riding surface comprising:

a first platform portion on the first riding surface, residing across a longitudinal snowboard centerline of the snowboard, and extending the length of the first riding surface and most of the width of the first riding surface, the first platform portion having a cross-section selected from the group consisting of a flat cross-section and a concave cross-section for straight riding; and first edge portions on the first riding surface along each side of the first platform portion, and having at least one first control surface for turning and stopping;

a second snowboard section;

a second riding surface on the bottom of the second snowboard section, the second riding surface comprising:

a second platform portion on the second riding surface, residing across the longitudinal snowboard centerline of the snowboard, and extending the length of the second riding surface and most of the width of the second riding surface, the second platform portion having a cross-section selected from the group consisting of a flat cross-section and a concave cross-section for straight riding; and second edge portions on the second riding surface along each side of the second platform portion, and having at least one second control surface for turning and stopping; and a connector comprising a length of reinforced hydraulic hose, the connector allowing moderate horizontal and vertical angular deflection of the first snowboard section with respect to the second snowboard section and not allowing noticeable twisting of the first snowboard section with respect to the second snowboard section while the snowboard is in use, wherein the first platform and the second platform are constructed by sandwiching a portion of a donor snowboard between the connector and a platform bottom.

2. The snowboard of claim 1, wherein the connector comprises a length of reinforced hydraulic hose, having steel reinforcing.

3. The snowboard of claim 1, wherein the connector comprises a length of reinforced hydraulic hose having no more than 0.005 degree of twisting per inch-pound of torque.

4. The snowboard of claim 1, wherein the flexure of the connector based on the ASTM Test Method D-790 and applying a force to the center of the connector supported by a six inch span, is between 0.001 inches and 0.018 inches of deflection per pound.

5. The snowboard of claim 1, wherein:

connector twist exhibits between approximately 0.001 degrees per inch-pound of torque and approximately 0.005 degree per inch-pound of torque; and between approximately 0.001 inches of deflection per pound and approximately 0.006 inches of deflection per pound in all directions when applying a force to the center of the connector supported by a six inch span using the ASTM Test Method D.

6. A two-piece snowboard comprising:

a first snowboard section;

a first riding surface on the bottom of the first snowboard section, the first riding surface comprising:

a first platform portion residing over a centerline of the snowboard and having a cross-section selected from the group consisting of a flat cross-section and a concave cross-section and residing against snow during straight riding; and first edge portions along each side of the first platform portion, and having at least one first control surface for turning and stopping;

a second snowboard section;

a second riding surface on the bottom of the second snowboard section, the second riding surface comprising:

a second platform portion residing over the centerline of the snowboard and having a cross-section selected from the group consisting of a flat cross-section and a concave cross-section and residing against the snow during straight riding; and second edge portions along each side of the second platform portion, and having at least one second control surface for turning and stopping; and a connector reaching continuously from the first snowboard section to the second snowboard section and having opposite ends fixedly attached to the first snowboard section and to the second snowboard section, and flexible over the length of the connector to allow moderate horizontal and vertical angular deflection of the first section with respect to the second section, wherein the connector allows only slight twisting of the first snowboard section with respect to the second snowboard section while the snowboard is in use, twisting of the connector being continuous along the length of the connector, wherein the first platform and the second platform are constructed by sandwiching a portion of a donor snowboard between the connector and a platform bottom.

7. The snowboard of claim 6, wherein opposite ends of the connector are embedded in the snowboard sections.

8. The snowboard of claim 6, wherein opposite ends of the connector reside in receptacles fixedly attached to the snowboard sections.

9. The snowboard of claim 6, wherein the opposite ends of the connector are held at each end by two spaced apart fasteners reaching through the receptacles and through the opposite ends of the connector.

10. The snowboard of claim 9, wherein the connector allows no more than 0.005 degree of twisting per inch-pound of torque and between approximately 0.001 inches of deflection per pound and approximately 0.006 inches of deflection per pound in all directions when applying a force to the center of the connector supported by a six inch span using the ASTM Test Method D-790.

11. The snowboard of claim 6, wherein the connector comprises a cylindrical form.

12. The snowboard of claim 6, wherein the platform portions each comprise approximately 75 percent of the first riding surface and the second riding surface.

13. A two-piece snowboard comprising:

a first snowboard section;

a first riding surface on the bottom of the first snowboard section, the first riding surface comprising:

a first platform portion residing across a centerline of the snowboard for straight riding, the first platform portion selected from a substantially flat surface and a concave surface; and first edge portions along each side of the first platform portion and raised above the first platform portion to avoid contact with snow while straight riding, and having at least one first control surface for turning and stopping;

a second snowboard section;

a second riding surface on the bottom of the second snowboard section, the second riding surface comprising:

a second platform portion residing across the centerline of the snowboard for straight riding, the second platform portion selected from a substantially flat surface and a concave surface; and second edge portions along each side of the second platform portion and raised above the second platform portion to avoid contact with snow while straight riding, and having at least one second control surface for turning and stopping; and a connector reaching continuously from the first snowboard section to the second snowboard section, the connector continuously flexible over the length of the connector to allow moderate horizontal and vertical angular deflection of the first section with respect to the second section, wherein the connector does not allow a noticeable twisting of the sections about the connector axis in opposite directions when the snowboard is being ridden, wherein the first platform and the second platform are constructed by sandwiching a portion of a donor snowboard between the connector and a platform bottom.

14. The snowboard of claim 13, wherein the connector reaches horizontally between the snowboard sections.

15. The snowboard of claim 13, wherein:

the platform portions comprise flat center portions of the bottoms of the snowboard sections, the platform portions extending the length of each section and covering most of the width of the bottoms; and the control surfaces include features selected from the group consisting of ridges and stopping edges, and wherein the control surfaces are substantially disengaged from the snow during straight riding, and engage the snow by tilting the snowboard during turning and slowing.

16. The snowboard of claim 13, wherein:

the platform portions have a flat lateral cross-section; and the control surfaces are recessed away from a snow surface when the platform portion is laying flat against the snow surface supporting a rider to avoid engaging the snow when riding in a straight line.

17. The snowboard of claim 13, wherein the connector reaches continuously from the first snowboard section to the second snowboard section, the connector continuously flexible over the length of the connector to allow moderate horizontal and vertical angular deflection of the first section with respect to the second section, wherein the continuous flexure of the connector based on the ASTM Test Method D-790 and applying a force to the center of the connector supported by a six inch span, is between 0.001 inches and 0.018 inches of deflection per pound.

* * * * *